US005574435A

United States Patent [19]

Mochizuki

[11] Patent Number: 5,574,435

[45] Date of Patent: Nov. 12, 1996

[54] PHOTOELECTRIC TYPE FIRE DETECTOR

[75] Inventor: Mikio Mochizuki, Tokyo, Japan

[73] Assignee: Nohmi Bosai, Ltd., Tokyo, Japan

[21] Appl. No.: 571,699

[22] Filed: Dec. 13, 1995

Related U.S. Application Data

[63] Continuation of Ser. No. 219,374, Mar. 29, 1994, abandoned.

[30] Foreign Application Priority Data

Mar. 31, 1993 [JP] Japan ..... 5-096712

[51] Int. Cl.[6] ..... G08B 21/00

[52] U.S. Cl. ..... 340/630; 250/573; 250/574; 356/431

[58] Field of Search ..... 340/628, 630; 250/573, 574; 356/431

[56] References Cited

U.S. PATENT DOCUMENTS

| | | | |
|---|---|---|---|
| 3,678,488 | 7/1972 | Skala | 340/236 |
| 4,266,220 | 5/1981 | Malinowski | 340/630 |
| 4,300,133 | 11/1981 | Solomon | 340/630 |
| 4,388,616 | 6/1983 | Machida | 340/628 |
| 4,687,924 | 8/1987 | Galvin | 250/216 |
| 4,749,871 | 6/1988 | Galvin et al. | 340/630 |
| 4,757,306 | 7/1988 | Kimura | 340/630 |
| 4,977,527 | 12/1990 | Shaw et al. | 364/511.03 |
| 5,473,167 | 12/1995 | Minnis | 250/573 |

FOREIGN PATENT DOCUMENTS

| | | | |
|---|---|---|---|
| 0066363 | 12/1982 | European Pat. Off. . | |
| 0248957 | 12/1987 | European Pat. Off. . | |
| 2059128 | 4/1981 | United Kingdom . | |
| 8101765 | 6/1981 | WIPO | 250/574 |

*Primary Examiner*—Jeffery Hofsass
*Assistant Examiner*—Julie B. Lieu
*Attorney, Agent, or Firm*—Wenderoth, Lind, & Ponack

[57] ABSTRACT

A photoelectric type fire detector includes self-testing capabilities. An upper level threshold limit and a lower level threshold define a predetermined range for output levels of an amplifier connected to an output of a light receiving element. In a self-test mode, a gain set in the amplifier is increased automatically. The number of times in which the amplifier output level deviates from the predetermined range is counted. If the deviation count exceeds a predetermined count threshold, it is determined that the photoelectric type fire detector is abnormal.

5 Claims, 2 Drawing Sheets

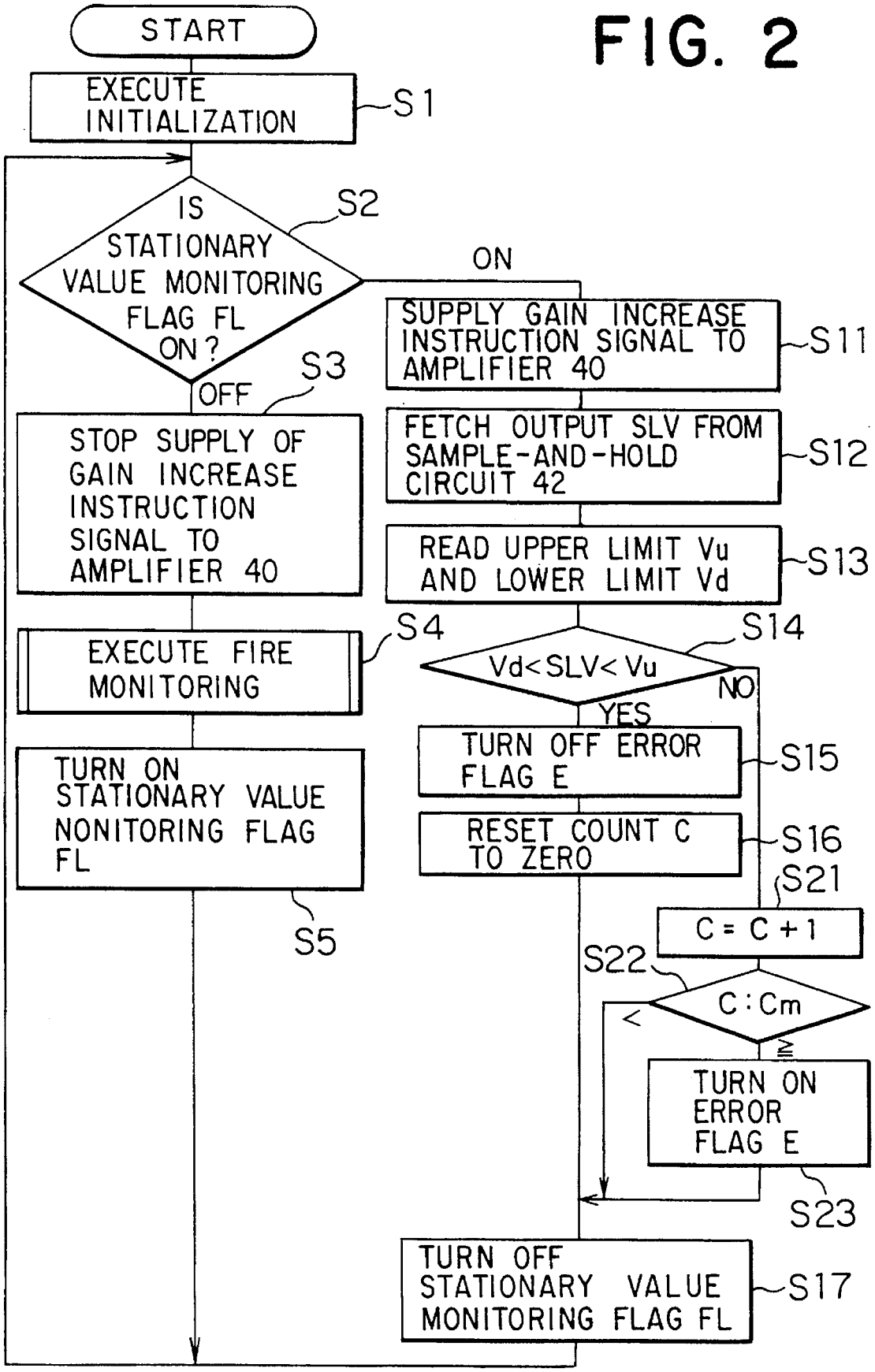
FIG. 2
START
EXECUTE INITIALIZATION
S1
IS STATIONARY VALUE MONITORING FLAG FL ON ?
S2
ON
OFF
S3
STOP SUPPLY OF GAIN INCREASE INSTRUCTION SIGNAL TO AMPLIFIER 40
EXECUTE FIRE MONITORING
S4
TURN ON STATIONARY VALUE NONITORING FLAG FL
S5
SUPPLY GAIN INCREASE INSTRUCTION SIGNAL TO AMPLIFIER 40
S11
FETCH OUTPUT SLV FROM SAMPLE-AND-HOLD CIRCUIT 42
S12
READ UPPER LIMIT Vu AND LOWER LIMIT Vd
S13
Vd<SLV<Vu
S14
NO
YES
TURN OFF ERROR FLAG E
S15
RESET COUNT C TO ZERO
S16
S21
C = C + 1
S22
C : Cm
<
≧
TURN ON ERROR FLAG E
S23
TURN OFF STATIONARY VALUE MONITORING FLAG FL
S17

PHOTOELECTRIC TYPE FIRE DETECTOR

This application is a Continuation of now abandoned application, Ser. No. 08/219,374, filed Mar. 29, 1994.

BACKGROUND OF THE INVENTION

1. Field of the Invention

The present invention relates to a photoelectric type fire detector in a fire alarm system, or more particularly, to a self-contained self-test.

2. Description of the Related Art

A photoelectric type fire detector includes a light emitting element and a light receiving element both lying in a dark chamber. Light emanating from the light emitting element is scattered with smoke. The scattered light is detected by the light receiving element. The detected quantity of light is amplified by an amplifier. The level of an output signal of the amplifier is analyzed to determine a smoke density. Thus, fire monitoring is effected. The photoelectric type fire detector not only performs fire monitoring, but also performs what is referred to as stationary value monitoring. For stationary value monitoring, a stationary value (which is output by the amplifier in a non-fire state) is detected in the photoelectric type fire detector, and then a trouble in the photoelectric type fire detector is identified using the detected stationary value.

The stationary value is much smaller than the output levels of the amplifier resulting from the occurrence of a fire. When the stationary value is used as it is, it is hard to determine whether the photoelectric type fire detector is abnormal.

A prior art for allowing a photoelectric type fire detector to detect an own trouble is described in Japanese Examined Patent Publication No. 64-4239. The prior art has a light emitting element, a light receiving element for receiving light from the light emitting element, and an upper limit comparator and a lower limit comparator for comparing an output signal of the light receiving element with an upper limit and a lower limit respectively. A fire receiver is used to remotely control the comparators in the photoelectric type fire detector.

In the above prior art, the photoelectric type fire detector itself cannot detect its own trouble without controlling the comparators in the photoelectric type fire detector from the fire receiver. This results in a heavy work load on the fire receiver.

SUMMARY OF THE INVENTION

An object of the present invention is to provide a photoelectric type fire detector capable of self-detecting and reporting its own trouble at an early stage.

According to the present invention, an upper limit and a lower limit are pre-set for an output level of an amplifier. In the course of self-testing, a gain set in the amplifier is increased automatically at a predetermined interval. In each self-test interval, it is detected whether or not the output level of the amplifier resulting from the increase in gain deviates from a range defined by the upper limit and lower limit. Then a time interval during which the output level of the amplifier is detected as deviating from the range is measured. When the time interval exceeds a predetermined maximum, it is determined that the photoelectric type fire detector is abnormal. By increasing the gain, a trouble can be identified reliably. Moreover, since stationary value monitoring can be executed frequently, a trouble in the photoelectric type fire detector can be reported at an early stage. Furthermore, the photoelectric type fire detector itself can detect its own trouble.

BRIEF DESCRIPTION OF THE DRAWINGS

FIG. 2 is a flowchart showing the operations to be executed by a microcomputer 10 in the embodiment shown in FIG. 1.

DETAILED DESCRIPTION OF THE PREFERRED EMBODIMENTS

Figure 1:
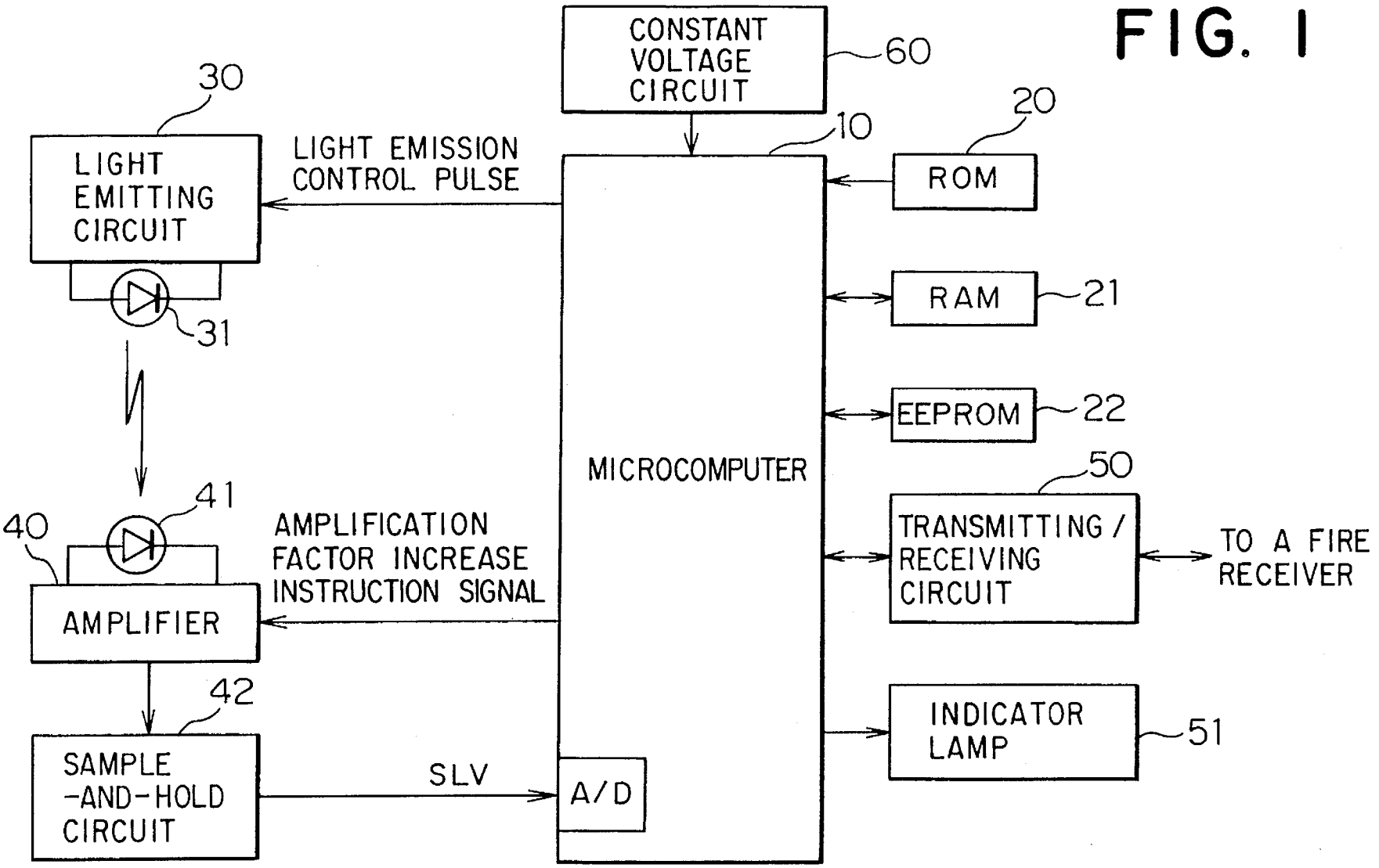
FIG. 1 is a block diagram showing an embodiment of the present invention.

FIG. 1 is a block diagram showing an embodiment of the present invention.

In this embodiment, a microcomputer 10 controls the whole of a photoelectric type fire detector. A ROM 20 contains a program shown in the flowchart of FIG. 2. A RAM 21 offers a work area, and stores a stationary value monitoring flag FL to be turned on when stationary value monitoring is needed, an output voltage SLV of a sample-and-hold circuit 42, an error flag E indicating that the photoelectric type fire detector is abnormal, and a count value C. The count value C is the number of times output level is detected as indicating a possibility that the photoelectric type fire detector may be abnormal.

An EEPROM 22 stores an address of the photoelectric type fire detector in a fire alarm system, set values, an upper limit Vu and a lower limit Vd for the output level of an amplifier, and a maximum count Cm. The maximum count Cm is a maximum permissible number of the count value indicative of a maximum continuous-time in which the output level of an amplifier 40 resulting from an increase in amplification factor deviates from a range defined by the upper limit Vu and lower limit Vd.

The microcomputer 10 detects that the output level of the amplifier 40 resulting from the increase in amplification factor deviates from the range defined by the upper limit Vu and lower limit Vd. The number of output levels of the amplifier 40 resulting from the increase in amplification factor and consecutively deviating from the above range is counted to measure a time interval during which the output level of the amplifier 40 consecutively deviates from the range. When the number of output levels which deviates from the range exceeds the maximum count Cm, the photoelectric type fire detector is determined to be abnormal. These operation are also performed by the microcomputer 10.

In response to a light emission control pulse sent from the microcomputer 10, a light emitting circuit 30 supplies a current pulse for light emission to the light emitting element 31. The amplifier 40 amplifies an output level of the light receiving element 41 at a given amplification factor. The amplifier 40 uses a normal amplification factor during fire self-monitoring. During stationary value monitoring for monitoring of an abnormality, the amplifier 40 responds to an amplification factor increase instruction signal added from the microcomputer 10 and uses another amplification factor whose value is larger than that used during fire monitoring. After stationary value monitoring is completed, the normal amplification factor is reused for amplification. Thus, the amplifier 40 uses two amplification factor values alternately.

A transmitting/receiving circuit 50 includes a transmitting circuit for sending a signal representing a physical quantity of smoke density, a fire signal, an error signal and other signals to a fire receiver (not shown), and a receiving circuit for receiving signals such as a call signal sent in part of polling initiated by the fire receiver and for transferring the received signals to the microcomputer 10. An indicator lamp 51 lights when the photoelectric type fire detector shown in FIG. 1 detects a fire. A constant voltage circuit 60 supplies constant voltage using a voltage fed over a power supply/signal line (not shown). A/D shown in the microcomputer 10 in FIG. 1 denotes an analog-digital converter.

A pair of the microcomputer 70 and amplifier 40 is an example of amplification factor increasing means for increasing an amplification factor set in the amplifier in the course of detecting a smoke density for fire monitoring. The EEPROM 22 is an example of a range setting means for defining an upper limit and a lower limit for output level of the amplifier. The microcomputer 10 is an example of a comparing means for detecting that the output level of the amplifier resulting from an increase in amplification factor deviates from the range defined with the upper and lower limits. The microcomputer is also an example of a counting means for counting the number of output levels of the amplifier resulting from an increase in amplification factor and consecutively deviating from the above range. The microcomputer 10 is also an example of a trouble identifying means that when the number of output levels exceeds the maximum count, determines that the photoelectric type fire detector is abnormal.

Next, the operation of the aforesaid embodiment will be described.

FIG. 2 is a flowchart showing the operations to be executed by the microcomputer 10.

Firstly, initialization is executed (step S1). If the stationary value monitoring flag FL stored in the RAM 21 is off (step S2), fire monitoring is executed. Supply of an amplification factor increase indicating signal to the amplifier 40 is stopped (step S3). The amplification factor set in the amplifier 40 is returned to the normal one. A light emission control pulse is output to the light emitting circuit 30. Then the light emitting circuit 30 causes the light emitting circuit 31 to emit light. Light received by the light receiving element 41 is amplified by a normal gain. Fire monitoring is then executed (step S4). When the fire monitoring terminates, the stationary value monitoring flag FL is turned on in preparation for the succeeding stationary value monitoring (step S5).

Control is then returned to step S2. Since the stationary value monitoring flag FL is on, an amplification factor increase indicating signal is sent to the amplifier 40 so that the amplifier 40 increases the gain (step S11). A light emission control pulse is output to the light emitting circuit 30. The amplifier 40 amplifies the light received by the light receiving element 41 at a high amplification factor so that stationary value monitoring can be effected easily using the output signal of the light receiving element 41. An output voltage SLV is fetched from the sample-and-hold circuit 42 (step S12), and then placed in the RAM 21. The upper limit Vu and lower limit Vd are read from the EEPROM 22 (step S13), and then placed in the RAM 21. The output voltage SLV of the sample-and-hold circuit 42 is compared with the upper limit Vu and lower limit Vd (step S14). If the output voltage SLV of the sample-and-hold circuit 42 is an intermediate value between the upper limit Vu and lower limit Vd, the photoelectric type fire detector is normal. The error flag E existent in the RAM 21 is therefore turned off (step S15). The count value C indicating a possibility of a trouble is reset to "0" (step S16). A sequence of stationary value monitoring terminates. The stationary value monitoring flag FL is then turned off in preparation for the succeeding fire monitoring (step S17).

At step S14, if the output voltage SLV of the sample-and-hold circuit 42 has a larger value than the upper limit Vu, it can be regard that a insect or dust has entered the photoelectric type fire detector. A possibility that a trouble might occur in the photoelectric type fire detector is therefore identified. If the output voltage SLV of the sample-and-hold circuit 42 has a smaller value than the lower limit Vd, a possibility that an open might have occured in the photoelectric type fire detector is identified. In either of the events, there is a possibility that the photoelectric type fire detector enters an abnormal state. The count C indicating the possibility of a trouble is incremented by one (step S21). At this time, the maximum count Cm for the count C is read from the EEPROM 22, and then compared with the count C (step S22). If the count C is the maximum count Cm or larger, it is determined that the photoelectric type fire detector is abnormal. The error flag E is then turned on (step S23). A sequence of stationary value monitoring terminates. The stationary value monitoring flag FL is then turned ore in preparation for the succeeding fire monitoring (step S17).

If the microcomputer 10 receives a state return instruction sent from the fire receiver, which is not shown in FIG. 2, the microcomputer 10 returns the state of the error flag E together with an address of the photoelectric type fire detector. In this stage, if the error flag E is on, the fire receiver can recognize that the photoelectric type fire detector is abnormal.

In the aforesaid embodiment, if the fire receiver sends many state return instructions to each photoelectric type fire detector, the fire receiver can be aware of an abnormal state of a photoelectric type fire detector in an early stage. Further, since the photoelectric type fire detector itself executes stationary value monitoring, the photoelectric type fire detector can therefore detect its own trouble by itself. This results in the reduced load on the fire receiver.

In the aforesaid embodiment, at steps S14 and S21 in FIG. 2, the number of output voltages SLV of the sample-and-hold circuit 42 having larger values than the upper limit Vu is added to the number of output voltages SLV of the sample-and-hold circuit 42 having smaller values than the lower limit Vd. The number of output voltages SLV of the sample-and-hold circuit 42 having larger values than the upper limit Vu may be counted separately from the number of output voltages SLV of the sample-and-hold circuit 42 having smaller values than the lower limit Vd. The maximum count Cm for use when the output voltage SLV has a smaller value than the lower limit Vd may then be set to a larger value than the maximum count Cm for use when the output voltage SLV has a larger value than the upper limit Vu.

According to the present invention, a photoelectric type fire detector can report its own abnormal state to the fire receiver in an early stage. Moreover, since the photoelectric type fire detector itself executes stationary value monitoring, the photoelectric type fire detector can detect its own trouble by itself. This results in the reduced load on the fire receiver.

What is claimed is:

1. A photoelectric type fire detector comprising:

a light emitting element;

a light receiving element which receives scattered light emitted from said light emitting element and scattered by smoke particles;

an amplifier which amplifies an output signal of said light receiving element; and a control circuit, coupled to said light emitting and light receiving elements and to said amplifier, for alternately and repeatedly operating in fire monitoring mode and self-testing mode time intervals, said control circuit comprising:

(a) means for detecting a smoke density according to an output signal of said amplifier during each fire monitoring mode time interval and for generating an alarm signal when the smoke density exceeds a predetermined level;

(b) means for setting an output range defined by an upper threshold and a lower threshold;

(c) means for increasing an amplification factor set in said amplifier during each self-testing mode time interval relative to an amplification factor set in said amplifier during each fire monitoring mode time interval;

(d) means for comparing a level of said output signal of said amplifier with said output range during each self-testing mode time interval;

(e) means for counting a number of times in which the level of said output signal of said amplifier deviates from said output range;

(f) means for setting a threshold value for said number of times; and (g) means for detecting an abnormality in said photoelectric-type fire detector when said number of times exceeds said threshold value and for generating an error signal when detecting said abnormality.

2. A photoelectric-type fire detector according to claim 6, wherein said means for counting cumulatively counts the number times in which the level of said output signal of said amplifier exceeds said upper threshold and is less than said lower threshold.

3. A photoelectric type fire detector according to claim 1, wherein said means for setting said threshold value sets first and second threshold values which are different from each other, wherein said means for counting separately counts a first number of times in which the level of said output signal of said amplifier exceeds said upper threshold and a second number of times in which the level of said output signal of said amplifier is less than said lower threshold, and wherein said means for detecting an abnormality detects an abnormality when either said first number of times exceeds said first threshold value or said second number of times exceeds said second threshold value.

4. A photoelectric type fire detector according to claim 3, wherein in said first threshold value is less than said second threshold value.

5. A photoelectric type fire detector according to claim 1, wherein said control circuit includes an EEPROM, a ROM and a microcomputer, wherein said microcomputer operates according to a program stored in said ROM, and wherein said means for setting the output range and said means for setting the threshold value are realized by said EEPROM.

* * * * *